US009364767B2

(12) United States Patent
Fox et al.

(10) Patent No.: US 9,364,767 B2
(45) Date of Patent: Jun. 14, 2016

(54) TOY BUILDING BLOCK

(71) Applicants: Olivia Fox, Independence, MO (US); Seth Ian Fox, Independence, MO (US)

(72) Inventors: Olivia Fox, Independence, MO (US); Seth Ian Fox, Independence, MO (US)

( * ) Notice: Subject to any disclaimer, the term of this patent is extended or adjusted under 35 U.S.C. 154(b) by 0 days.

(21) Appl. No.: 13/860,646

(22) Filed: Apr. 11, 2013

(65) Prior Publication Data

US 2013/0330998 A1 Dec. 12, 2013

Related U.S. Application Data

(60) Provisional application No. 61/658,581, filed on Jun. 12, 2012.

(51) Int. Cl.

| | |
|---|---|
| ***A63H 33/04*** | (2006.01) |
| ***A63H 33/06*** | (2006.01) |
| ***A63H 33/08*** | (2006.01) |

(52) U.S. Cl.

CPC ..... *A63H 33/04* (2013.01); *A63H 33/062* (2013.01); *A63H 33/086* (2013.01)

(58) Field of Classification Search

CPC ... A63H 33/04; A63H 33/046; A63H 33/086; A63H 33/062; A63H 33/08; B65D 11/1833; B65D 21/086; B65D 5/4208; B65D 5/029; B65D 2543/00296; B65D 21/0231; B65D 21/0213; B65D 88/022; B65D 2519/00174; B65D 2519/00034; B65D 2519/00069; B65D 2519/00273; Y01S 229/915

USPC ..... 446/85, 120, 121, 124, 487, 488; 220/6, 220/7, 666, 62; 206/508, 509, 511, 512; 229/915

See application file for complete search history.

(56) References Cited

U.S. PATENT DOCUMENTS

| | | | | | |
|---|---|---|---|---|---|
| 349,646 | A | * | 9/1886 | Grigg | 446/128 |
| 3,577,671 | A | * | 5/1971 | Woollett | 446/124 |
| 3,581,431 | A | | 6/1971 | Trenovan | |
| 3,670,449 | A | * | 6/1972 | Lemkin et al. | 446/102 |
| 3,702,520 | A | | 11/1972 | Huber et al. | |
| 3,744,700 | A | * | 7/1973 | Stegmann | 229/122.23 |
| 4,249,336 | A | * | 2/1981 | Moe et al. | 446/102 |
| 4,254,574 | A | * | 3/1981 | Stock | 446/128 |
| 4,482,074 | A | * | 11/1984 | Lalley | B65D 5/005 220/4.28 |
| 4,509,930 | A | * | 4/1985 | Schweigert et al. | 446/109 |
| 4,581,793 | A | * | 4/1986 | Micklitz | 24/697.1 |
| 4,619,365 | A | * | 10/1986 | Kelly | B65D 5/006 206/503 |
| 4,965,106 | A | | 10/1990 | DeChristopher | |
| 4,968,040 | A | * | 11/1990 | McElhaney | 273/294 |
| 4,990,116 | A | * | 2/1991 | Chen | 446/124 |

(Continued)

*Primary Examiner* — Michael Dennis
*Assistant Examiner* — Urszula M Cegielnik
(74) *Attorney, Agent, or Firm* — Daniel Boudwin; Global Intellectual Property Agency

(57) ABSTRACT

A child building block is provided having a collapsible structure that is formed of a flat sheet material and is erected into a cuboid shape having connector elements to remain stable and for adjoining adjacent building blocks during fort construction. When the sheet material is connected and the block is erected, the block forms an upper surface having a pair of upstanding protrusions thereon, a pair of side walls, and a pair of end walls that are perpendicularly attached with an open lower. Adjoining edges of the block are secured using a simple push tab and tab receiving area. The upstanding protrusion of the block upper surfaces fits within the open lower of a corresponding block member positioned thereover. Finally, adjacent blocks can be aligned with one another and secured together, allowing construction in a grid pattern.

8 Claims, 3 Drawing Sheets

(56) References Cited

U.S. PATENT DOCUMENTS

| | | | | |
|---|---|---|---|---|
| 5,035,666 | A * | 7/1991 | Kang | 446/118 |
| 5,125,867 | A | 6/1992 | Solomon | |
| 5,226,275 | A * | 7/1993 | Trahan | 52/592.6 |
| 5,453,034 | A * | 9/1995 | Larws | 446/103 |
| 5,647,185 | A * | 7/1997 | Forlini | 52/604 |
| 5,662,508 | A | 9/1997 | Smith | |
| 6,142,365 | A * | 11/2000 | Breitbach | 229/198.2 |
| 6,257,411 | B1 * | 7/2001 | Bacques | B65D 5/001 206/508 |
| 6,508,690 | B2 * | 1/2003 | Axelrad | 446/108 |
| 7,229,002 | B1 * | 6/2007 | Burch, Jr. | B65D 5/64 229/120 |
| 8,348,087 | B2 * | 1/2013 | Sawaki | 220/592.2 |
| 8,726,618 | B1 * | 5/2014 | Laurita | B65D 11/1833 206/509 |
| 8,733,573 | B2 * | 5/2014 | Lucht | 220/62.1 |
| 8,756,894 | B2 * | 6/2014 | Swartz et al. | 52/604 |
| 2003/0038051 | A1 * | 2/2003 | Bennett | B65D 5/0025 206/509 |
| 2006/0059824 | A1 | 3/2006 | Barbisch | |
| 2009/0242554 | A1 * | 10/2009 | Robinson et al. | 220/6 |
| 2011/0206872 | A1 | 8/2011 | Swartz et al. | |

* cited by examiner

TOY BUILDING BLOCK

CROSS REFERENCE TO RELATED APPLICATION

This application claims the benefit of U.S. Provisional Application No. 61/658,581 filed on Jun. 12, 2012, entitled "Create a Kingdom." The above identified patent application is herein incorporated by reference in its entirety to provide continuity of disclosure.

BACKGROUND OF THE INVENTION

1. Field of the Invention

The present invention relates to assemblable building blocks for children. More specifically, the present invention pertains to a new and unique construction for a child building block that is comprised for a formed sheet of material that is manufactured to fold into a block for fort building and child entertainment purposes.

Children need entertainment during days off from school to occupy their young minds and to direct their energy. When children become bored, they can become difficult to handle for parents, as the children may act out or get into trouble. Television provides a useful getaway and an amusement device for children; however this is only a partial solution and one that is not recommended for long periods of time. Parents should encourage their children to remain active and get out of the house, therefore while television is entertaining, it should not replace traditional forms of "play" for a child.

Typical outdoor activities include playing with neighbors and friends, playing different sports, and playing with different toys. One particular type of toy is the building block, which ranges in size and provide a means for a child to create a structure to their liking using their imagination and creativity. Larger building blocks can be utilized to create enclosures, or "forts", where the child can be creative in its construction and act out a storyline associated with the fort with friends. A useful type of building block includes coupling means between adjacent block members, wherein a stable structure can be erected with no tools or fasteners, and thereafter broken down into its constituent units after playtime.

A common problem with most building blocks is that they consume too much space when stowed, or that they are too complex for a child to operate independently of adult supervision. Static blocks are defined structures that remain in one state, thereby consuming considerable volume within the home when not being used. Deployable construction blocks, by contrast, allow a flat sheet or blank of material to be folded and secured in a manner that transforms the flat material into a three dimensional shape suitable for stacking or building upon. These devices, however, must remain simple in their construction if they are designed for child use, as a multiple folding members and connector elements can quickly overwhelm a young child and defeat the purpose of the entertainment exercise.

The present invention provides a new and novel toy building block device having a flat material construction that is specifically designed to fold into a formed cuboid block, whereby adjoining edges of the block are secured using a simple push tab and tab receiving area. When the tabs are secured and the block is erected, the block forms an upper surface, a pair of side walls, and a pair of end walls that are perpendicularly attached to form the cuboid shape with an open lower. The upper portion of the block comprises at least one upstanding protrusion to fit within the interior of a corresponding block member open lower section positioned thereover. Finally, adjacent blocks can be aligned with one another and secured together utilizing the same push tab and tab receiving area or the upper protrusion of an underlying block secured within an upper block. In this way, upstanding wall structures can be erected in a grid pattern as desired by the child.

2. Description of the Prior Art

Devices have been disclosed in the prior art that relate to toy building blocks for children to use in constructing play structures and makeshift forts. These include devices that have been patented and published in patent application publications, and generally relate to planar structures that are folded into three dimensional blocks, whereby fold lines and connector elements provide a means to secure the otherwise flat material into an upstanding block structure. The present invention provides a new and unique design for a building block that allows a child to assemble the block from a flat shape and further alignably stack the assembled blocks thereafter for building temporary play structures. The following is a list of devices deemed most relevant to the present disclosure, which are herein described for the purposes of highlighting and differentiating the unique aspects of the present invention, and further highlighting the drawbacks existing in the prior art.

One such device related to an assemblable block from a planar structure is U.S. Pat. No. 3,581,431 to Trenovan, which discloses a building block formed from a foldable blank, wherein the blank forms a bottom panel, a pair of side panels, end panels, and a pair of top panels. When assembled, the device forms a block structure largely devoid of exterior protrusions for freely stacking the blocks as desired. The folding blank includes tabs that enter into the interior of the block, which when formed establish interior walls that subdivide the interior and provide a greater load carrying capacity for the assembled block. While the Trenovan device discloses a block assemblable from a flat material, the device is more suited for carrying load of a child standing thereon rather than for use erecting larger fort structures using aligned and connectable block structures in a grid like manner.

Still other devices relate to child toy blocks that include connector elements between them. These devices provide unique assemblies that are formed from flat sheets having defined fold lines and connector elements. Yet these devices fail to disclose the novel elements of the present invention, notably the attachment means of the block and between blocks.

U.S. Pat. No. 3,702,520 to Huber is one such device that discloses a construction block that is foldable from a flat sheet to a block shape that establishes a container suitable for filling the block interior with available solid material. The device is adapted for use in habitation construction and erecting semi-permanent structures using available solid materials and a construction that is rapid and low cost. Interlocking tab means secure adjacent blocks from above, wherein the tabs insert into a longitudinal slot along the top surface of an existing block. The Huber device provides a useful building block, but is suited for actual building applications for human habitation rather than for child use in temporary play structures.

Another device is U.S. Pat. No. 5,662,508 to Smith, which discloses a toy building block constructed of a paperboard blank, wherein the block folds into a largely rectangular shape having upwards tabs along its upper end and tab receiving slots along its lower end. The upstanding tabs of adjacent blocks, which comprise semicircular protrusions, can be fitted within the tab receiving slots of blocks placed thereover. In this way, the blocks can be securely stacked to form walls aligned with or perpendicular to the underlying block. The Smith device provides a stackable and alignable block, but fails to disclose the same connector elements along the sides of the device (push tabs) and the open bottom/upper protrusion connector along the top of the present block structure.

Similarly, U.S. Pat. No. 5,125,867 to Solomon discloses a folded sheet material forming a toy block having planar surfaces, wherein adjacent blocks can be assembled and connected by way of apertures and a removably connected protrusion means extending outwardly through the apertures in one block and secured therein. The protrusion is secured between the folded sheet material, whereby the cylindrical protrusion is secured by way of its lower flange along its inner end, which is sandwiched between the folded material layers. The means of connecting adjacent elements requires a removable structure that is not integrated into the Solomon sheet material. This limitation is expressly unwanted in the present invention, which provides integrated connector elements for complimentary receiving elements of adjacent block structures.

Finally, U.S. Patent Publication No. 2011/0206872 to Swartz discloses a corrugated board that is foldable into a cuboid block structure and connectors, whereby the block structure includes topside and bottomside holes for accepting therethrough the folded, polyhedron connector element. In this way, the device comprises a two-part assembly that connects adjacent cuboid structures using an insertable connector element therethrough. The Swartz disclosure, similar to the Solomon device, provides a removable and external connector element that is not desired herein by the present block structure.

The present child toy block structure provides a child building block that is formed of a sheet material, wherein the sheet is cut to allow folding into a cuboid block shape having upper surface protrusions, an open lower, and corner connector elements to allow for block erection. The device provides an entertainment device for children to build forts and enclosures during playtime, while the structure of the blocks can be broken down into planar members for storage. The structure and design of the present invention substantially diverges in elements from the prior art. Consequently it is clear that there is a need in the art for an improvement to existing amusement building block devices. In this regard the instant invention substantially fulfills these needs.

SUMMARY OF THE INVENTION

In view of the foregoing disadvantages inherent in the known types of amusement building block devices now present in the prior art, the present invention provides a new building block device that can be utilized for providing convenience for the user when providing a child with a means to create a fort or play structure based on their imagination and using simple-to-use and manipulate block structures.

It is therefore an object of the present invention to provide a new and improved amusement building block device that has all of the advantages of the prior art and none of the disadvantages.

It is another object of the present invention to provide an amusement building block device that is formed of a flat blank material, wherein the flat material also includes the upper surface protrusions and the block edge connector elements.

Another object of the present invention is to provide an amusement building block device that can easily be erected and disassembled using a few fold processes and securement of edge connector elements.

Yet another object of the present invention is to provide an amusement building block device that can readily connect to adjacent building blocks to create a structure in any grid pattern, wherein the blocks can stack above or below, or adjacent in any direction.

Another object of the present invention is to provide an amusement building block device that is simple and relatively inexpensive to manufacture for mass production.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
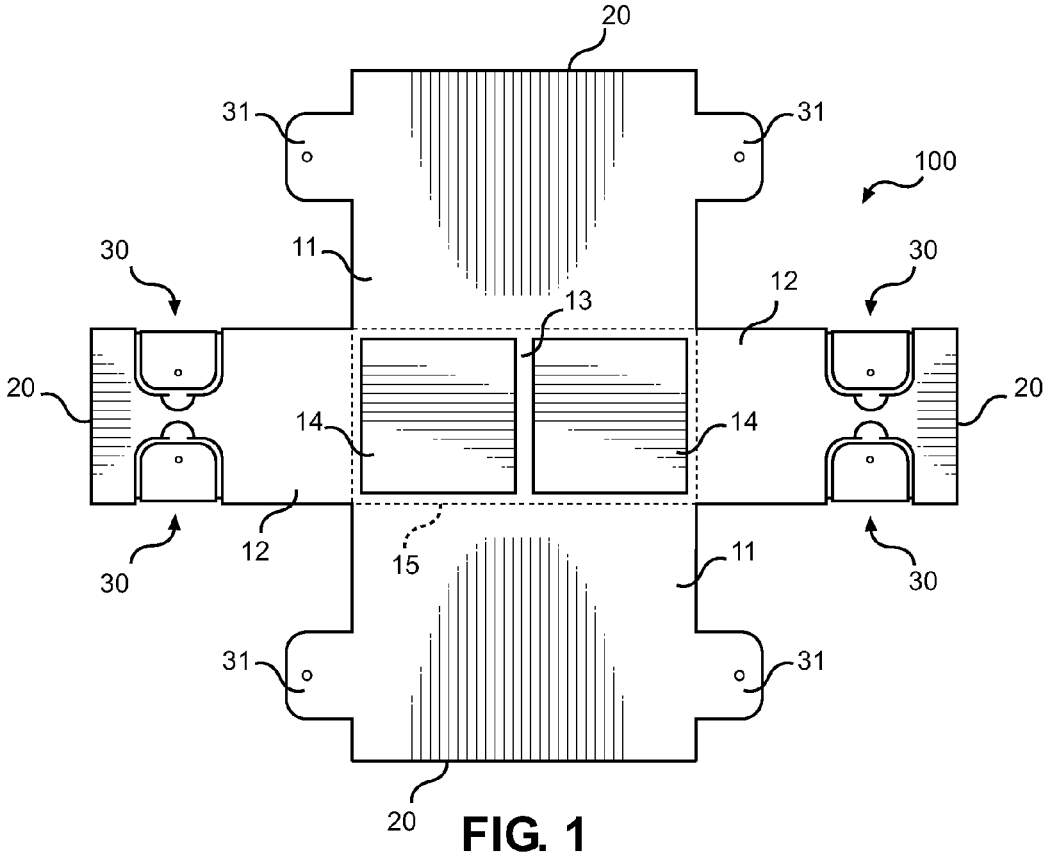
FIG. 1 shows an overhead view of the building block in its flatted, pre-assembled state.

Reference is made herein to the attached drawings. Like reference numerals are used throughout the drawings to depict like or similar elements of the toy building block device. For the purposes of presenting a brief and clear description of the present invention, the preferred embodiment will be discussed as used for providing a child with a building block that can be easily assembled and then arranged in a grid pattern for constructing a temporary structure or play fort. The figures are intended for representative purposes only and should not be considered to be limiting in any respect.

Figure 5:
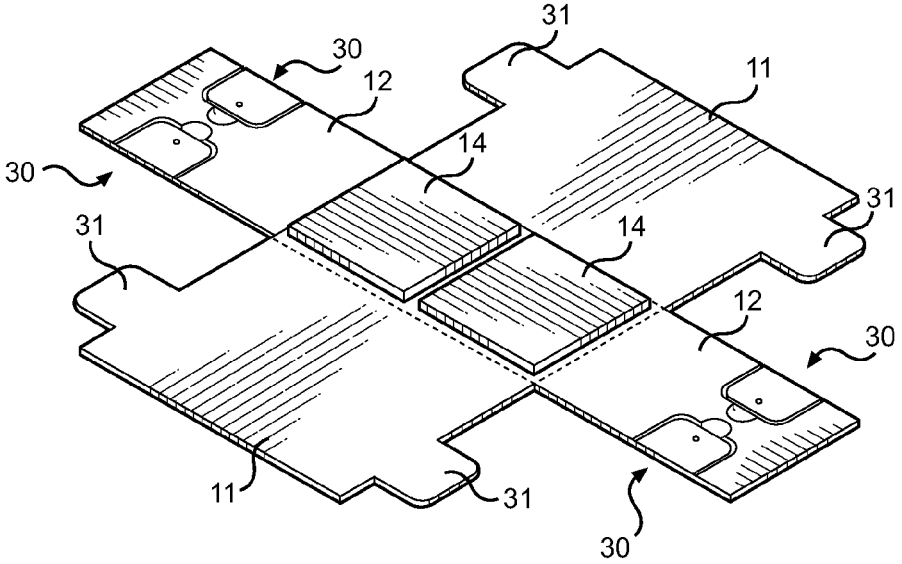
FIG. 5 shows an overhead perspective view of the building block in its flatted, pre-assembled state.

Referring now to FIGS. 1 and 5, there are shown views of the building block of the present invention in its planar state 100. The block comprises a cut sheet material comprising a central upper surface 13, a pair of end walls 12, and a pair of sidewall surfaces 11 that are joined along mitered fold lines 15 that allow the walls to readily fold towards one another and join their edge lines. Each of the walls is largely rectangular in shape, wherein both the end walls 12 and sidewalls 11 are opposedly connected to the upper surface 13 when in a flatted configuration. When assembled, the block resembles an upstanding cuboid shape, wherein the edges of each wall are connected together by way of a snap connector element. The connector element maintains the assembled structure of the block, whereby the connector element bridges across the gap between adjacent walls to retain its assembled shape. To erect a vertical structure, the upper surface 13 of the block includes at least one protrusion 14 that is adapted to secure within the open lower of a block placed thereover. When assembled, the block includes rectangular upstanding protrusions along the upper surface and an open lower to allow for stacking. In this way, adjacent blocks can be secured together from below to form a stable structure in a grid pattern.

The edge connector elements comprise a first tab element 31 having a male snap member extending therefrom. This tab 31 extends from one wall (i.e. the sidewall 11) and folds over an adjoining wall (i.e. the end wall 12) to secure the two walls together along the adjoining edge. Along the end walls 12 at a corresponding location is a tab receiving element 30, which accepts the tab 31 therein and includes a corresponding female snap-receiving element adapted to accept a male snap element from the tab. When connected, the tab 31 is flush with the outer surface of the end wall 12, preventing any surface deviations. Finally, the outer edges 20 of the walls, when assembled, establish the open lower edge of the block that is adapted to receive the upper protrusions 14 therethrough.

Figure 2:
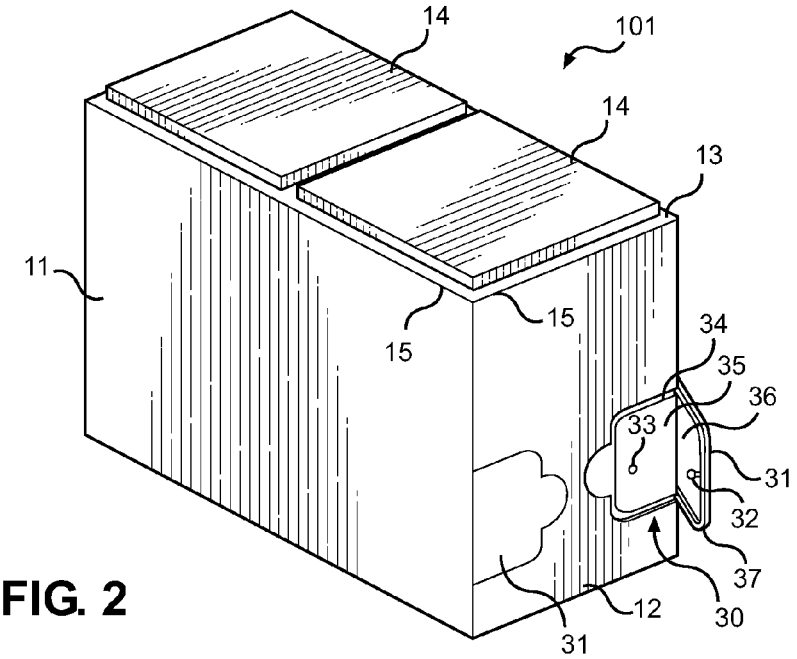
FIG. 2 shows a perspective view of the present building block in its assembled state.

Referring now to FIG. 2, there is shown a perspective view of the building block of the present invention in an assembled state 101. In this view, the block upper surface 13 is supported in an elevated position by the upstanding and connected sidewall 11 and end wall 12 surfaces, which have been folded along the fold lines 15 and aligned with one another. Joining the sidewalls 11 and end walls 12 is the tab 31 and tab receiving element 30 along adjacent walls. The tab receiving element 30 includes a perimeter channel 34, a raised interior surface 35, and a snap receiving element 33. The tab 31 comprises a perimeter ledge 37 that is adapted to fit within the receiving element perimeter channel 34, while the tab interior surface 36 abuts against the raised interior surface 35 of the receiving element 30. The male snap connector 32 secures within the female snap receiving element 33 to secure the tab 31 and tab receiving element 30 together, and therefore secure the aligned edge of the end and sidewalls of the block. Once secured, the upper protrusions 14 allow the blocks to be connected and stacked, wherein the protrusion 14 fits within the open lower of an adjacent block. The protrusions are preferably provided in pairs, wherein a first and second protrusion is largely coextensive with the upper surface 13 to provide connection to two separate blocks if desired.

Figure 3:
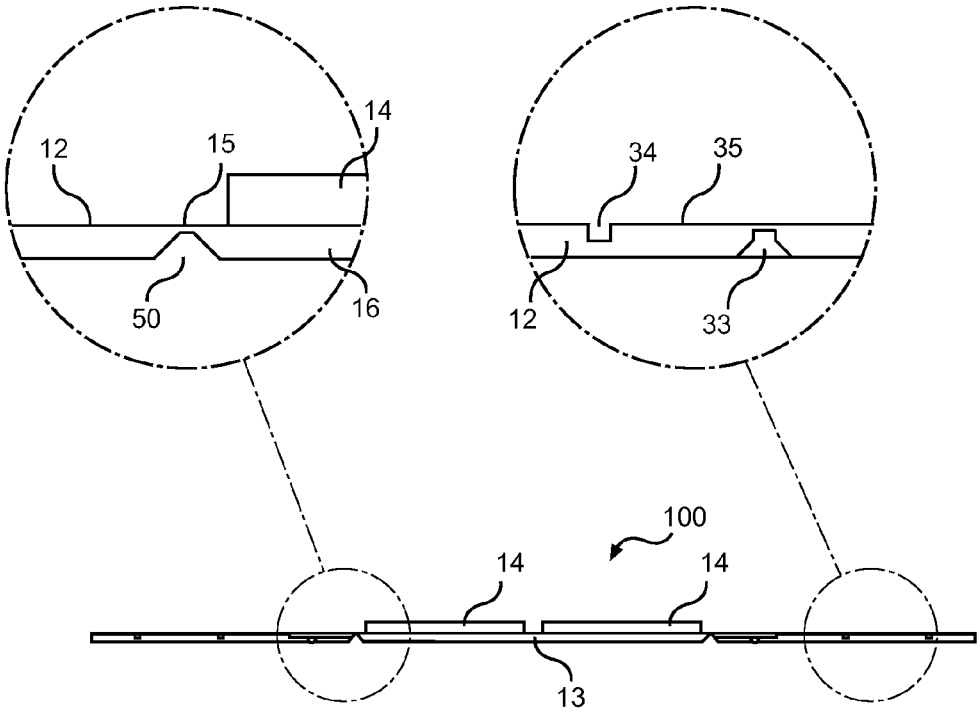
FIG. 3 shows a side view of the building block in its flatted state.

Referring now to FIG. 3, there is shown a side view of the building block of the present invention in a stowed and flattened state. This view first highlights the mitered fold line 15 that separates the upper surface 13 from the adjacent walls, wherein a user can easily fold this interface to create a defined corner. The backside of the sheet material includes a mitered channel 50, wherein folding this joint aligns the angles of the joint such that they are abutting and flush with one another. This view also highlights the structure of the tab receiving element 30, wherein the tab receiving element includes a perimeter channel 34, a raised interior surface 35, and a female snap receiving element 33.

Figure 4:
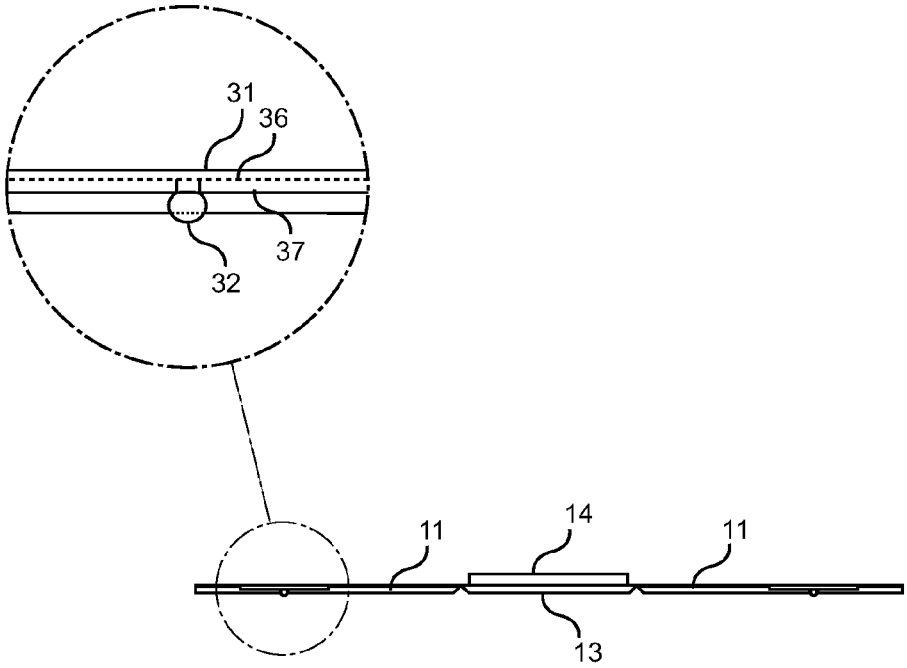
FIG. 4 shows an end view of the building block in its flatted state.

Referring now to FIG. 4, there is shown an end view of the building block in its stowed and flattened state. In this view, the tab 31 is highlighted on the block side wall 11, wherein the male snap connector element 32 is positioned thereon and along a depressed interior surface 36 bounded by a perimeter flange 37. This structure allows the tab to nest within the structure of the tab receiving area when connecting thereto, eliminating any surface adulations or non-uniformities around the connector element area of each block.

As shown in FIGS. 3 and 4, the upper surface 13 includes upstanding protrusions 14 that are adapted to secure within adjacent assembled blocks. The protrusions 14 are areas of the flattened sheet material that includes built-up material or adhered structure. When assembled, these protrusions 14 provide a means to connect two adjacent blocks and to align them during play structure or play fort construction.

Figure 6:
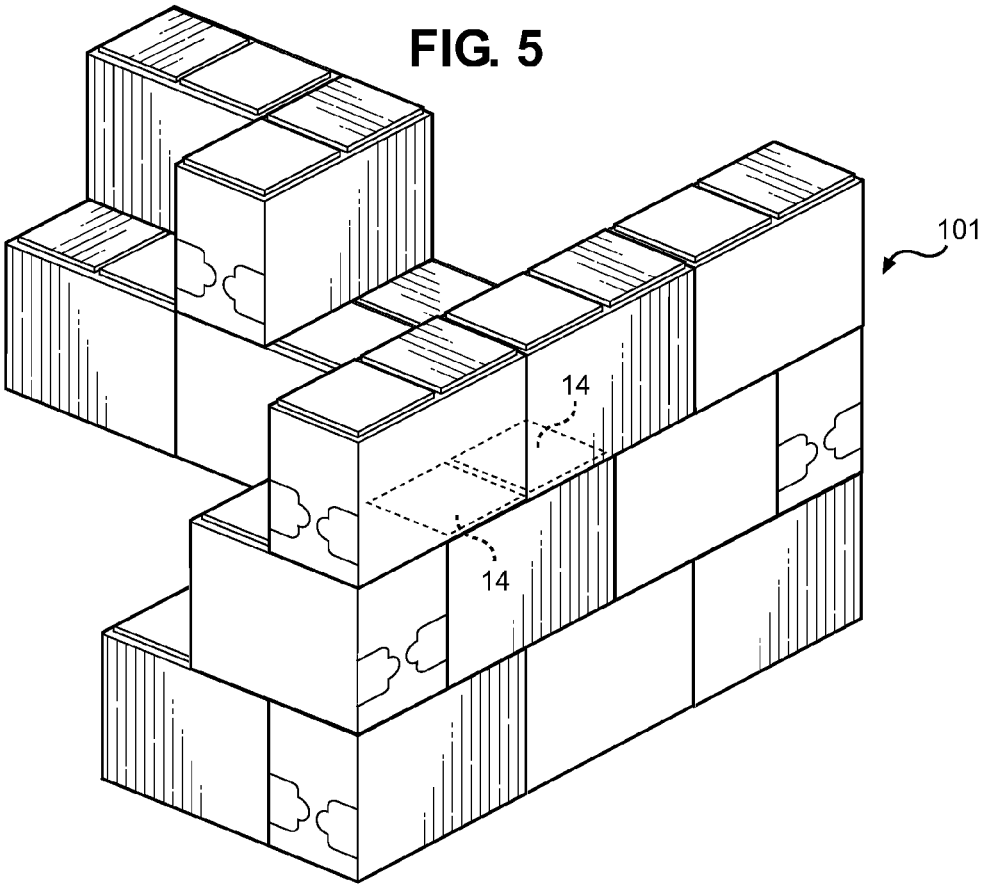
FIG. 6 shows a plurality of the assembled blocks in use building a play structure.

Referring now to FIG. 6, there is shown a view of the present building block in it assembled state and in a working position, being utilized in conjunction with a plurality of like-blocks to for a grid-pattern structure by a child user. As shown, the upper surface protrusions 14 secure within the open lower of each corresponding block thereabove to secure the two blocks together, allowing for stacking and for building of a structure in any grid layout. In this way, a child can assemble the blocks into their assembled state 101 and thereafter stack the blocks as desired for fort creation or other playtime activity.

The present invention describes a toy building block for entertainment and child enjoyment use. The block comprises a folding structure made from a flat blank of a preferably plastic material that snaps together to from a three dimensional block structure that is easy to handle and stack. Once assembled, the blocks interlock using the protrusions and lower openings, providing a child with an easy way to set up a fort, both indoors and outdoors. The device allows children to design their own play space, pushing them to use their creativity and imagination in a fun way. Children can build these forts both indoors and outdoors, making them versatile no matter the weather. Both parents and children can appreciate the benefits afforded by the simple, assemblable block structure.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toy building block, comprising:

a planar material comprising an upper surface, a first and second sidewall surface opposedly connected to said upper surface, and a first and second end wall surface opposedly connected to said upper surface;

said side wall surfaces and said end wall surfaces mating with said upper surface along a fold line;

wherein said side wall surfaces and said end wall surfaces are hingably connected to said upper surface along said fold line;

said upper surface, side wall, and end wall surfaces comprising largely rectangular shapes such that when folded along said fold line, said surfaces form a cuboid shape with an entirely open lower end;

said upper surface comprising at least one protrusion element adapted to fit within the dimensions of said open lower end;

said open lower end opposing said upper surface configured to receive at least one protrusion element of a second toy building block; and connector elements for removably securing adjacent end wall and side walls edges;

wherein said connector elements further comprises a tab element positioned along said sidewalls edges and a tab receiving element positioned along said end wall edges;

wherein said tab element having a perimeter ledge along an interior surface that is bounded by an upstanding ledge about said interior surface;

wherein said tab receiving element having a perimeter channel to accept a tab flange therein, said channel bounding an elevated interior surface adapted to abut said tab interior surface;

wherein said tab element further includes a male snap element disposed at a central location thereof and said tab receiving element includes a female snap element at a central location thereof adapted to receive said male snap element therein;

wherein said tab element is flush with said end wall surface when said female snap element receives said male snap element.

2. The device of claim 1, wherein said at least one upper surface protrusion element further comprises a first and second protrusion element largely coextensive with the block upper surface.

3. The device of claim 1, wherein said fold line comprises a mitered corner joint.

4. The device of claim 1, wherein said tab receiving element further comprises a groove extending beyond said tab element when said female snap element receives said male snap element.

5. A toy building block, comprising:

a housing having an upper surface with a pair of end walls opposedly connected thereto and a pair of side walls opposedly connected thereto;

wherein said side walls and said end walls mate with said upper surface along a fold line;

wherein said side walls and said end walls are hingedly connected to said upper surface along said fold line;

wherein said housing is planar in a collapsed position;

said upper surface, said side walls, and said end walls comprising largely rectangular shapes such that when folded along said fold line, said housing forms a cuboid shape in a upright position having an entirely open lower end defining an open interior therein;

said upper surface comprising one or more protrusion elements adapted to fit within the dimensions of said open lower end;

wherein said open lower end is adapted to receive one or more protrusion elements of a second toy building block;

connector elements for removably securing adjacent end walls and side walls;

wherein said connector elements further comprise a tab positioned along an edge of said side walls and a receiver positioned along an edge of said end walls;

wherein said tab comprises a perimeter ledge along an interior surface that is bounded by an upstanding ledge about said interior surface;

wherein said receiver comprises a perimeter channel configured to accept a tab flange therein; and said perimeter channel bounding an elevated interior surface adapted to abut said tab interior surface;

wherein said tab further comprises a central male snap element and said receiver further comprises a central female snap element adapted to mate with said central male snap element via a snap connection such that said tab is flush with said end wall thereby securing said side walls and said end walls in said upright position.

6. The device of claim 5, wherein said protrusion elements further comprise a first protrusion element and a second protrusion element largely coextensive with said upper surface.

7. The device of claim 5, wherein said fold line comprises a mitered corner joint.

8. The device of claim 5, wherein said receiver further comprises a groove extending beyond said when said central female snap element mates with said central male snap element.

* * * * *